US008418758B2

(12) United States Patent
Hradecky

(10) Patent No.: US 8,418,758 B2
(45) Date of Patent: Apr. 16, 2013

(54) JARRING TOOL WITH MICRO ADJUSTMENT

(75) Inventor: Jason A. Hradecky, The Woodlands, TX (US)

(73) Assignee: Impact Selector, Inc., Rockwell, TX (US)

( * ) Notice: Subject to any disclaimer, the term of this patent is extended or adjusted under 35 U.S.C. 154(b) by 353 days.

(21) Appl. No.: 12/850,413

(22) Filed: Aug. 4, 2010

(65) Prior Publication Data

US 2011/0030944 A1 Feb. 10, 2011

Related U.S. Application Data

(60) Provisional application No. 61/273,380, filed on Aug. 4, 2009.

(51) Int. Cl.
*E21B 23/00* (2006.01)
*E21B 31/107* (2006.01)

(52) U.S. Cl.
USPC ..... 166/178; 166/301; 166/242.7

(58) Field of Classification Search ..... 166/178, 166/301, 242.7; 403/326, 327, 330
See application file for complete search history.

(56) References Cited

U.S. PATENT DOCUMENTS 4,076,086 A 2/1978 Evans
4,212,355 A * 7/1980 Reardon ..... 166/336
4,566,546 A 1/1986 Evans
4,646,830 A 3/1987 Templeton
4,805,699 A 2/1989 Halbardier
4,844,183 A 7/1989 Evans
5,086,853 A 2/1992 Evans
5,103,903 A 4/1992 Marks, II
5,156,211 A 10/1992 Wyatt
5,212,354 A 5/1993 Miller et al.
5,318,139 A 6/1994 Evans
5,503,228 A 4/1996 Anderson
5,507,347 A 4/1996 Estilette, Sr.
5,613,561 A * 3/1997 Moriarty ..... 166/387
5,624,001 A 4/1997 Evans
5,810,087 A 9/1998 Patel
5,826,660 A 10/1998 Rytlewski
5,875,842 A 3/1999 Wyatt
6,244,351 B1 6/2001 Patel et al.
6,290,004 B1 9/2001 Evans
6,321,848 B1 11/2001 Funk
6,349,771 B1 2/2002 Luke
6,481,495 B1 11/2002 Evans
6,604,582 B2 8/2003 Flowers et al.

(Continued)

*Primary Examiner* — Cathleen Hutchins
(74) *Attorney, Agent, or Firm* — Fellers, Snider, Blankenship, Bailey & Tippens, P.C.

(57) ABSTRACT

A jarring tool is disclosed. The tool has a segment of sub housing containing an upper stop proximate a first end thereof. An outer latch piece is connected to an upper end of the lower shaft inside the sub housing, and an upper shaft passes through the stop and connects on a first end thereof to an inner latch piece. A cap is on a second end of the upper shaft retaining a washer stack against the upper stop. A retainer is inside the sub housing and has an first piece providing a restraining region and an open region and a second piece attached to the sub housing. The retainer retains the inner and outer latch pieces in a latched position in the restraining region until the latch pieces are displaced toward the second end of the sub housing through the retainer to the open region as a result of a tensile force on the outer latch piece.

20 Claims, 4 Drawing Sheets

U.S. PATENT DOCUMENTS

| | | | | |
|---|---|---|---|---|
| 6,640,894 | B2 | 11/2003 | Bloom et al. | |
| 6,866,096 | B2 | 3/2005 | Tillett, Jr. | |
| 6,896,060 | B2 | 5/2005 | Tillett, Jr. | |
| 6,988,551 | B2 * | 1/2006 | Evans | 166/301 |
| 7,111,678 | B2 | 9/2006 | McElroy et al. | |
| 7,267,176 | B2 | 9/2007 | Madden | |
| 7,281,575 | B2 * | 10/2007 | McElroy et al. | 166/178 |
| 7,290,604 | B2 | 11/2007 | Evans | |
| 7,303,020 | B2 | 12/2007 | Bishop et al. | |
| 7,311,149 | B2 | 12/2007 | Evans | |
| 7,367,397 | B2 | 5/2008 | Clemens et al. | |
| 7,373,974 | B2 | 5/2008 | Connell et al. | |
| 7,424,910 | B2 | 9/2008 | Xu et al. | |
| 7,533,724 | B2 | 5/2009 | McLaughlin | |
| 7,559,361 | B2 | 7/2009 | Obrejanu | |
| 7,591,319 | B2 | 9/2009 | Xu | |
| 7,669,661 | B2 | 3/2010 | Johnson | |
| 7,775,280 | B2 | 8/2010 | Rose | |
| 2002/0074129 | A1 | 6/2002 | Moore | |
| 2003/0000707 | A1 | 1/2003 | Flowers et al. | |
| 2005/0092484 | A1 | 5/2005 | Evans | |
| 2007/0151732 | A1 | 7/2007 | Clemens et al. | |
| 2008/0000633 | A1 | 1/2008 | Xu et al. | |
| 2009/0314497 | A1 | 12/2009 | Johnson | |

* cited by examiner

JARRING TOOL WITH MICRO ADJUSTMENT

CROSS REFERENCE TO RELATED APPLICATIONS

This application claims the priority of U.S. Provisional Patent Application No. 61/273,380 entitled "JARRING TOOL WITH MICRO ADJUSTMENT," filed Aug. 4, 2009, the contents of which are hereby incorporated by reference.

FIELD OF THE INVENTION

This disclosure relates to downhole tools in general and, more specifically, to impact jars for freeing stuck tools.

BACKGROUND OF THE INVENTION

Drilling operations have become increasingly expensive as the need to drill in harsher environments, through more difficult materials, and deeper than ever before have become reality. Additionally, more testing and evaluation of completed and partially finished well bores has become a reality in order to make sure the well produces an acceptable return on investment.

In working with more complex and deeper well bores, a greater danger arises that work strings and tools will be stuck within the bore. In addition to the potential to damage equipment in trying to retrieve it, the operation of the well must generally stop while tools are fished from the bore. Moreover, with some fishing techniques, it is possible to damage the well bore itself.

Any tool designed for use in a downhole environment may be subject to heat, pressure, and unclean operating conditions. Internal components may be subject to repeated stresses that must be overcome in order to function reliably, and for a suitable length of time, to warrant inclusion in the work string. Additionally, economies may be realized by constructing a tool that is wear resistant enough to be used for a lengthy periods of time before breakdowns or rebuilds.

What is needed is a device for addressing the above and related concerns.

SUMMARY OF THE INVENTION

The invention of the present disclosure, in one aspect thereof, comprises a jarring tool. The tool has a segment of sub housing containing an upper stop proximate a first end thereof. An outer latch piece is connected to an upper end of the lower shaft inside the sub housing, and an upper shaft passes through the stop and connects on a first end thereof to an inner latch piece. A cap is on a second end of the upper shaft retaining a washer stack against the upper stop. A retainer is inside the sub housing and has an first piece providing a restraining region and an open region and a second piece attached to the sub housing. The retainer retains the inner and outer latch pieces in a latched position in the restraining region until the latch pieces are displaced toward the second end of the sub housing through the retainer to the open region as a result of a tensile force on the outer latch piece.

The tensile force required to unlatch the first and second latch pieces may be controlled by moving the first retainer piece relative to the second retainer piece by a threading engagement. The outer latch piece may be a collet that grasps the inner latch piece when latched.

Some embodiments may have a lower shaft attached to the outer latch piece on a first end thereof and providing a sub end on a second end thereof. A lower stop may be provided proximate the second end of the sub housing, the lower stop having a passage sized to permit extension of the lower shaft therethrough and away from the sub housing and to stop the extension of the shaft by contact with a shoulder of the shaft at a predetermined extension. An intermediate shaft may be provided and arranged in a sliding and concentric relationship to the inner and outer latch pieces to define a protected passageway.

A second segment of sub housing may be attached to the upper stop and provide an indicator that displaces and remains displaced in response to contact from the upper shaft cap resulting from unlatching of the inner and outer latch pieces. An access port may be defined in the sub housing and have an attached cover plate defining an opening of a predetermined size to control fluid flow into and out of the sub housing.

The invention of the present disclosure, in another aspect thereof comprises latch. An retainer defines a restrictive region and an open region therein, the retainer having cooperating first and second pieces whereby the restrictive region is axially adjustable by moving the first and second pieces relative to one another. The latch has an outer latch piece and an inner latch piece that is biased against movement through the retainer. The retainer retains the inner and outer latch pieces in a latched configuration in the restrictive region and allows the inner and outer latch pieces to unlatch when tensile forces applied to the outer latch piece move the latch pieces into the open region. In some embodiments, the cooperating first and second pieces each define cooperatively threaded cylinders.

The retainer may be anchored by a sub segment. The inner latch piece may be biased against movement through the retainer by a shaft attached to a spring washer stack. The outer latch piece may be connected to a sub end. In some embodiments, an intermediate shaft passes through the inner and outer latch pieces both in the latched and unlatched configuration.

In some embodiments, a substantially cylindrical housing circumscribes the retainer and has a stop in one end thereof. A shaft passes through the stop and connects to the outer latch piece inside the housing. The shaft provides a shoulder for impacting the stop to create a jarring impact in response to a tensile force applied to the shaft that unlatches the first and second latch piece.

DETAILED DESCRIPTION OF THE PREFERRED EMBODIMENTS

Figure 1A:
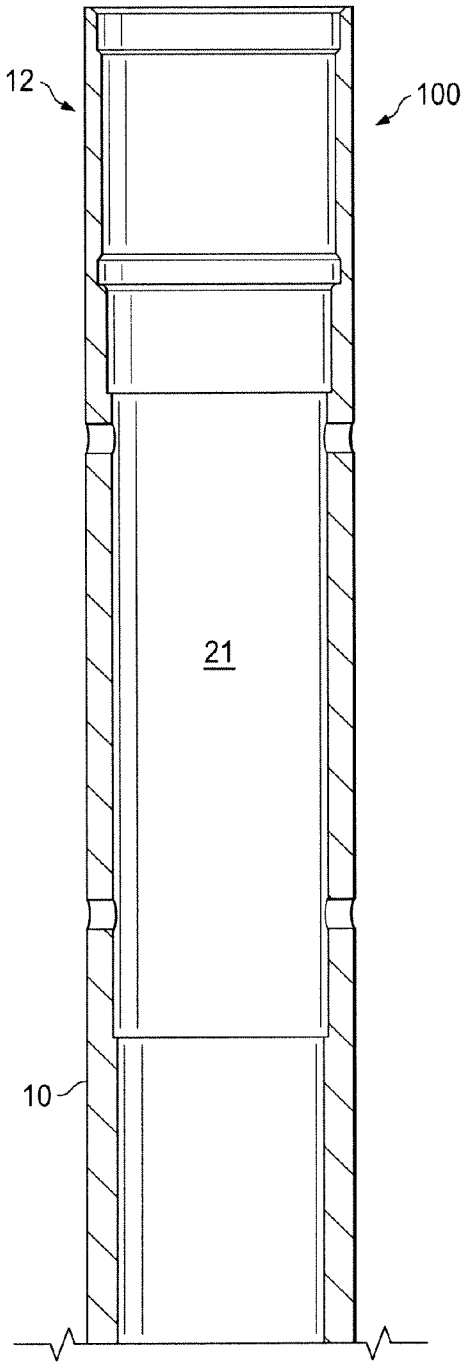
FIGS. 1A-1F taken together provide a side cutaway view of one embodiment of the jarring tool of the present disclosure.
Figure 1B:
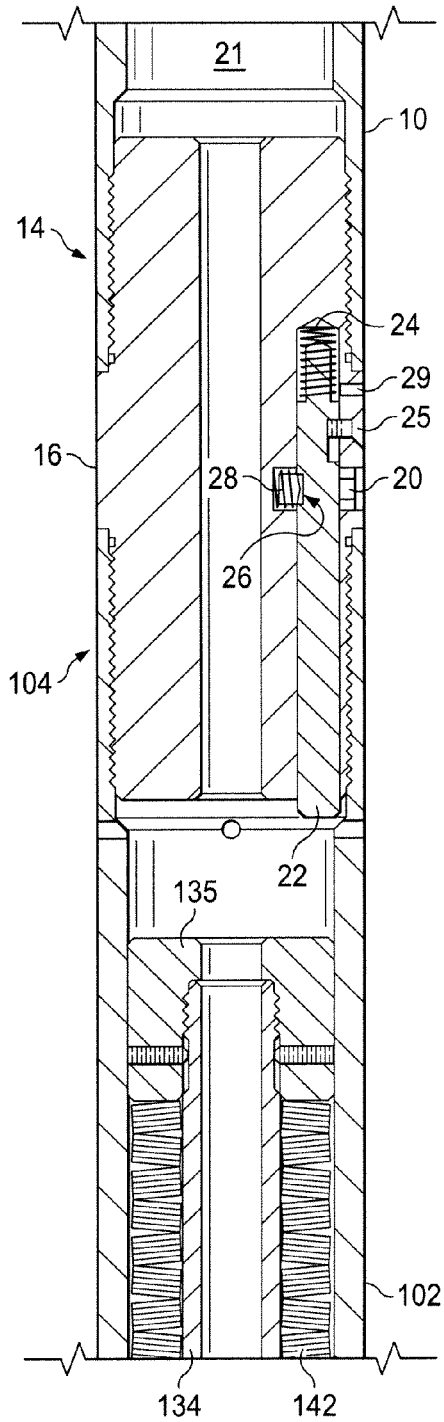
Figure 1C:
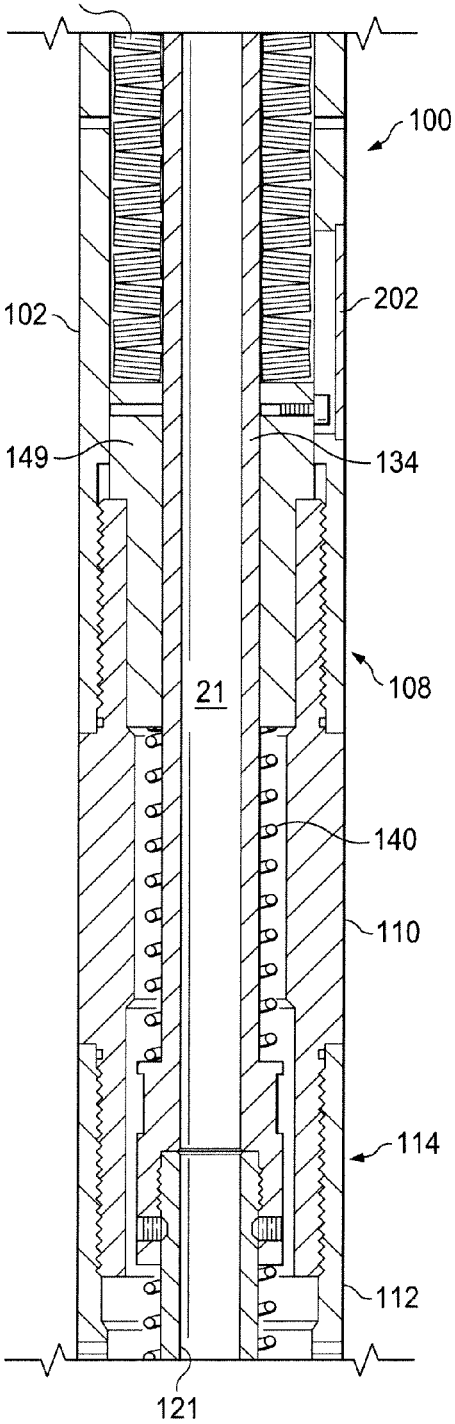
Figure 1D:
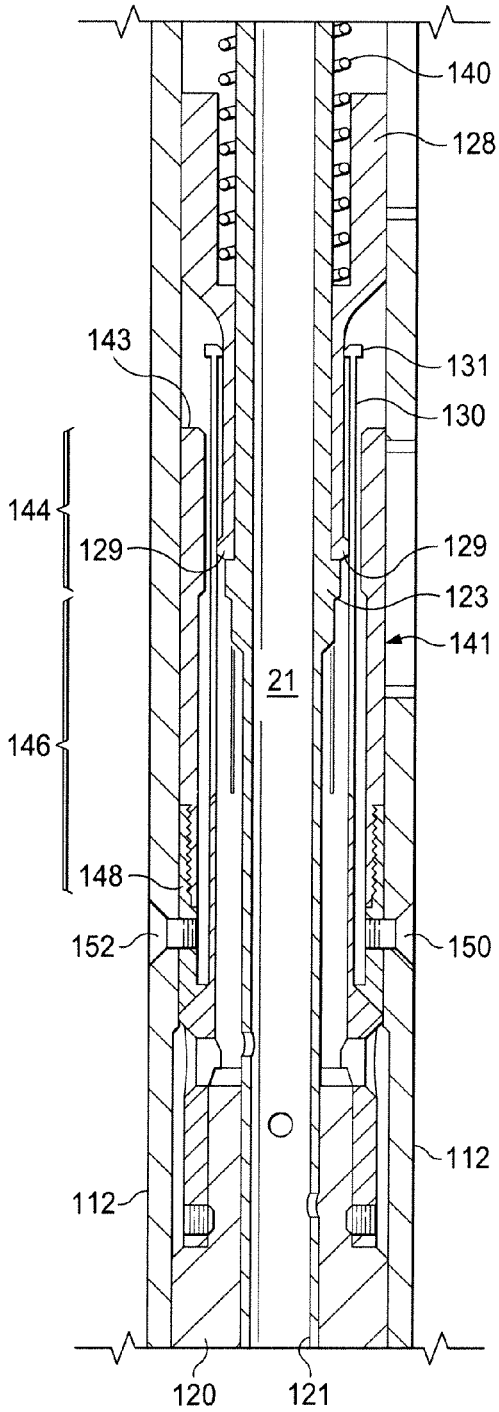
Figure 1E:
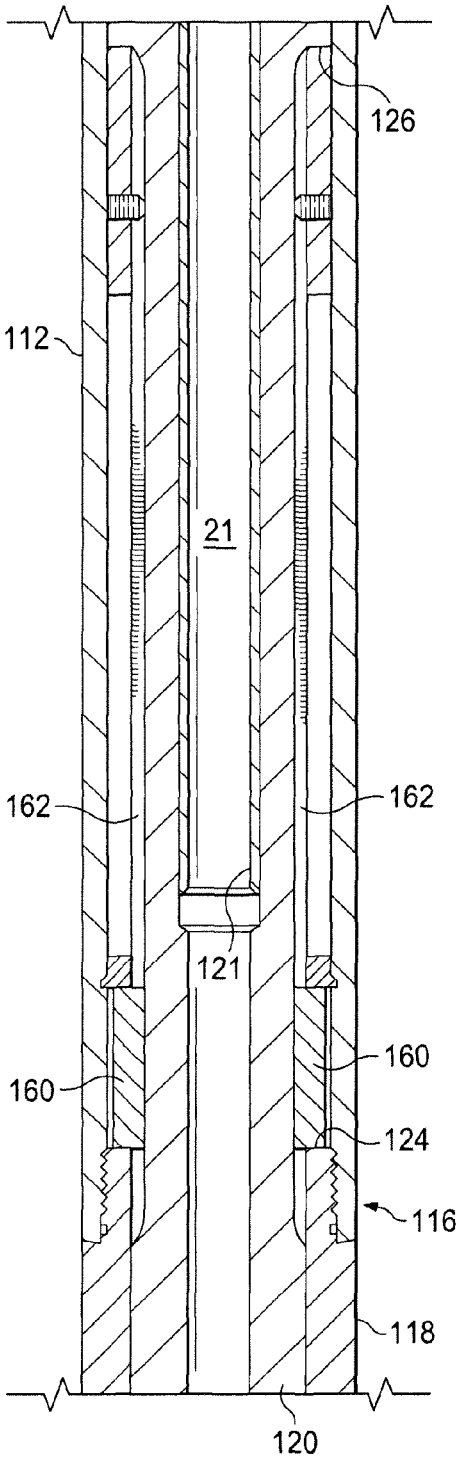
Figure 1F:
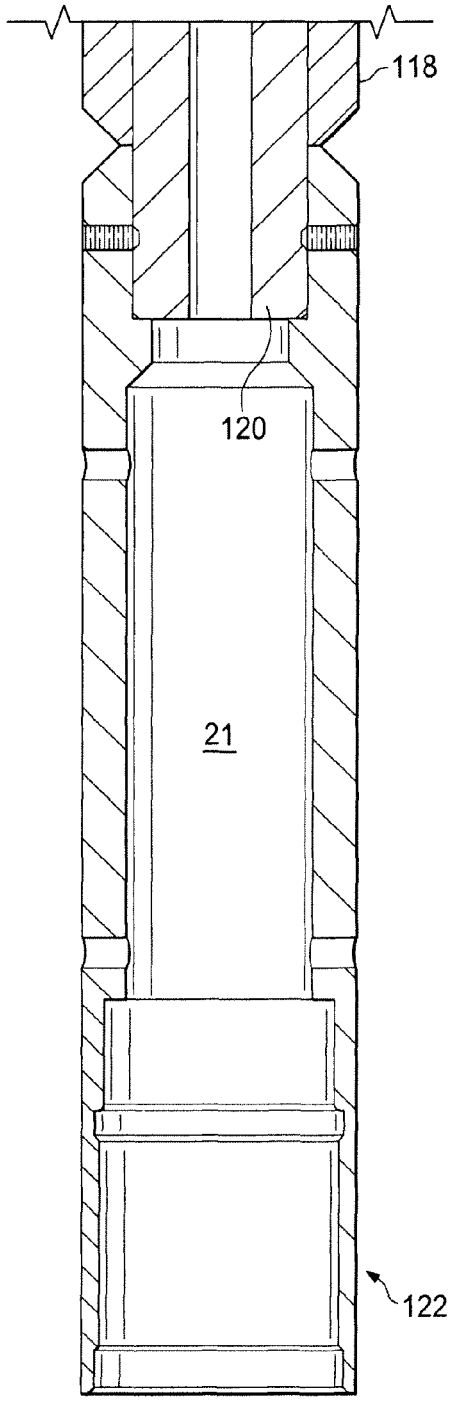

Referring now to FIGS. 1A-1F, a side cutaway view of one embodiment of a downhole jarring tool according to aspects of the present disclosure is shown. These drawings are meant to be understood sequentially as adjoining segments of a jarring tool 100. FIG. 1A illustrates the uppermost end of the tool 100, which is to be followed by FIG. 1B, FIG. 1C, etc. In the present embodiment, FIG. 1F illustrates the bottom most portion of the jarring tool 100.

In the present embodiment, the jarring tool 100 includes three sub housings: an upper sub housing 10 having a distal end 12 and a proximal end 14; a center sub housing 102 having a distal end 104 and a proximal end 108; and a lower sub housing 112 having a proximal end 114 and a distal end 116. The proximal end 14 of the upper sub housing 10 connects to the distal end 104 of the center sub housing 102 via an upper connector 16. The upper connector 16 may be a sub connector with threaded fittings. In the present embodiment, the upper connector 16 also provides an activation indicator 20 that provides a visual indication of whether the tool 100 has been activated. This may be useful when the tool 100 is withdrawn from a well bore.

It will be appreciated that the tool of the present disclosure may be adapted for use on slick line or e-line tool strings. In the present embodiment, the various components of the tool 100 provide a central passage way 21 that proceeds the entire length of the tool 100. Additionally, even though portions of the tool telescope with respect to one another, the central passageway 21 remains relatively protected from movements that can pinch or cut lines.

The functionality of the jarring operation of the tool 100 is described in greater detail below. However, the functionality of the upper connector 16 as an activation indicator may best be described here with particular reference to FIG. 1B. Before the tool 100 has been activated to produce a jarring effect on a work string, an activation rod 22 extends slightly beyond upper connector 16 toward an upper shaft cap 135. A rod spring 24 urges the rod 22 toward the cap 135. A set screw 25 prevents the rod 22 from falling out of the upper connector 16.

When in the unactivated position as shown, a recess 26 in the rod 22 is displaced toward the cap 135. The recess 26 provides clearance for the indicator 20 to pop out from its depressed position when the rod 22 is moved against the force of spring 24. A spring 28 provides the force to move the indicator 20. During activation of the tool 100, the cap 135 contacts the rod 22 which displaces it to allow the indicator 20 to pop up. The activator 20 is at least partially captive to the rod 22 to prevent it from coming completely free form the tool 100. For example, two halves of the indictor 20 may be threaded through the rod 22, or a 90 degree turn or series of turns may be required to completely free it. When the indicator 20 is pressed down, the rod spring 24 will urge the rod 22 back toward the cap 135, resetting the indicator. Various holes or ports, such as port 29 may be provided near or in upper connector 16 to prevent activation or resetting of the indicator 20 by bore pressure.

It will be appreciated that in embodiments where the activation indicator mechanism is not needed, the entire upper sub housing 10 and upper connector 16 could be removed from the tool. Similarly, the upper sub housing 10 could be removed leaving the upper connector 16 as an attachment point for the tool 100 in the work string.

Referring again now to the complete set of figures, center sub housing 102 attaches on the distal end 104 to the upper connector 16. The proximal end 108 of the upper sub housing 102 interconnects with a lower connector 110. The lower connector 110 joins the center sub housing 102 with a lower sub housing 112. The proximal end 114 of the lower housing 112 connects to the lower connector 110.

A distal end 116 of the lower housing 112 is connected to a lower stop 118. In the present embodiment, the lower stop 118 provides for sliding engagement and limited passage of a lower shaft 120. The lower shaft 120 may be interconnected to a lower sub end 122. The range of motion of the lower shaft 120 relative to the lower housing 112 may be limited by both the lower sub end 122 and by an inner shoulder 124 of the lower stop 118. The lower shaft 120 provides a shoulder 126, which will be too wide to pass through the lower stop 118. As will be described in greater detail below, when the jarring tool 100 is activated, the upper sub housing 10 will extend away from the lower sub end 122 to the point where inner shoulder 124 of the lower stop 118 contacts the lower shaft shoulder 126.

The lower shaft 120 connects to an outer latch piece 130 which cooperates with an inner latch piece latch piece 128. In the present embodiment, the outer latch piece 130 is a collet device that selectively grasps the inner latch piece 128, which functions as a stub for the collet. The interfitting inner and outer latch pieces 128, 130 are subjected to tensile forces of many thousands of pounds in operation. In order to secure adequate transmission of tensile forces between the inner latch piece 128 and the outer latch piece 130, the inner latch piece 128 may have a lip 129 extending substantially around a proximal end of the latch piece 128. Similarly, outer latch piece 130 may have a lip 131 on one or more collet fingers.

The lower shaft 120 is slidingly engaged with an intermediate shaft 121. The intermediate shaft 121 provides a circumferential stop 123 that selectively engages with the lip 129 of the inner latch piece 128, as further described below. The intermediate shaft 121 is also slidingly engaged through the inner latch piece 128 and connects to an upper shaft 134. The intermediate shaft 121 and upper shaft 134 function as a single connected unit, and in some cases may be a single shaft.

In the present embodiment, the upper shaft 134 is slidingly engaged through a connector stop 149 that interfits into the connector 110. It can be seen that a bias spring 140 surrounds a portion of the upper shaft 134 and the intermediate shaft 121 and presses against the inner latch piece 128. The lip 129 of the inner latch piece 129 engages the stop 129 on the intermediate shaft 121. Thus the inner latch piece 128, the intermediate shaft 121, and the upper shaft 134 are urged away from the stop 149 insofar as the other components will allow.

The upper shaft 134 partially proceeds through the stop 149 toward the distal end 104 of center sub housing 102. Within center sub housing 102 and surrounding upper shaft 134 is a washer stack 142. The washers of the washer stack 142 may be spring washers, such as Belleville washers. The cap 135 may retain the washer stack 142 on the upper shaft 134.

Referring back particularly to FIG. 1D, it can be seen that the inner latch piece 128 is shown nested within the outer latch piece 130, with the intermediate shaft 121 passing through both. This is the unactivated position. Under tensile force on the tool 100 (e.g., the distal end 12 of the upper sub housing 10 and the lower sub end 122), the lip 131 of the outer latch piece will move into contact with the stop 129 of the inner latch piece, which will be moved into contact with the stop 123 of the inner shaft if it is not already. This will cause the upper shaft 134 to begin compressing the washer stack 142.

A retainer 141 is fitted into the lower sub housing 112 in a position proximate the latch pieces 128, 130. The outer latch piece 130 will be restrained from pulling away from the inner latch piece 128 because of limited clearance inside the retainer 141. In the present embodiment, the retainer 141 is anchored in place to the lower subhousing by screws 150, 152. The retainer 141 comprises two pieces: an outer piece 148 into which screws 150, 152 may be threaded; and an inner piece 143 that is threaded into the outer piece 148.

The outer retainer piece 148 generally provides enough clearance to allow the inner and outer latch pieces 128, 130 to separate, but at least a portion of the inner retainer piece 143 does not. In the embodiment shown, a restrictive region 144 prevents the latch pieces 128, 130 from separating while an open region 146 allows the components to separate until tensile force. Because the inner and outer pieces 143, 148 are threaded together, the restrictive region 144 can be moved further from the washer stack 142. This will cause the washer stack 142 to undergo a greater degree of compression before the latch pieces 128, 130 can separate. In the present embodiment, the inner and outer pieces 143, 148 can be adjusted even after the tool 100 is assembled by a slot (not shown) on the housing 112. However, it is understood that, in operation or deployment of the tool, the inner and outer pieces 143, 148 remain fixed relative to one another and to the housing 112.

When the latch pieces 128, 130 disengage, the lower shaft 120 will no longer be retrained from moving away from the upper shaft 134. Under tensile force, the lower shaft will slide through the stop 118 until the stop shoulders 124 abut the shaft shoulders 126. Depending upon the tensile force applied, a large jarring force along the length of the tool 100 may be produced. This impact or upward jarring motion can be utilized to free stuck tools in a drilling well.

It will be appreciated that the greater the tensile strength applied to the tool 100 the greater the jarring force produced. The tool 100 relies upon acceleration of the upper sub housing 10 away from the sub end 122 to produce its jarring impact. It will be appreciated that the greater the tensile force required to activate the tool 100, the greater the impact jar will be. Coarse adjustments can be made by varying the spring rater and number of washers in the stack 142. However, finer adjustments can be made by moving the open region 146 closer to or further from the washer stack 142. This results in lesser or greater amounts of compression of the stack 142 that are required to pull the latch pieces 128, 130 through the restrictive region 144 and into the open region 146 where they can disconnect. The threading between the inner retainer piece 143 and the outer retainer piece 148 may be made relatively fine to allow for micro adjustments to be made to the release point of the tool 100. In this way, it can be tailored to the application at hand. A sufficient jar can be produced to free stuck tools, while keeping the impact small enough not to unnecessarily damage any part of the rig or work string. As discussed more fully below, ports or openings can be provided in the sub housings to allow for adjustment of the tool 100 even after assembly.

Following activation of the tool 100 producing the desired jar, the tool 100 may be reset while still in the bore. When compressive forces are applied to the activated tool 100, the outer latch piece will push against the stop 123 of the intermediate shaft 121 and/or the lip 129 of the inner latch piece 128 forcing them back through the restrictive region 144 where there is sufficient clearance for the pieces to relatch. The bias spring 140 will then act to push the inner latch lip 129 and stop 123 back into the restrictive region 144 as is shown in FIG. 1D. At this point the tool 100 has been reset and can be used again to produce additional jarring. As described above, indicator 20 on the upper connector 16 can be examined to determine that the tool 100 has been deployed at least once while down hole.

It will be appreciated that the configuration of the latching mechanism operates to maintain the central passageway 21 through the nested and sliding arrangement of the components. This allows for safe passage of a communications or power line through the tool 100 in instances where it is needed. The sub housings can be fitted with electrical connections as needed to facilitate the user of the tool 100 as an e-line tool.

As the tool 100 may be utilized as part of an active work string, the tool 100 may connect to other tools further down the string and function as an ordinary segment of drill pipe until activated. In order to prevent the lower shaft 120 and lower sub connector 122 from rotating relative to the upper sub housing 10, the lower stop 118 may be provided with rigid inserts 160 that are slidably engaged with slots 162 on the lower shaft 120. This configuration allows for telescoping extension of the tool 100 to produce the desired jarring effect as described, but also allows the tool 100 to transmit rotational movement that may be needed in the work string to rotate a drill bit or other tool.

Figure 2:
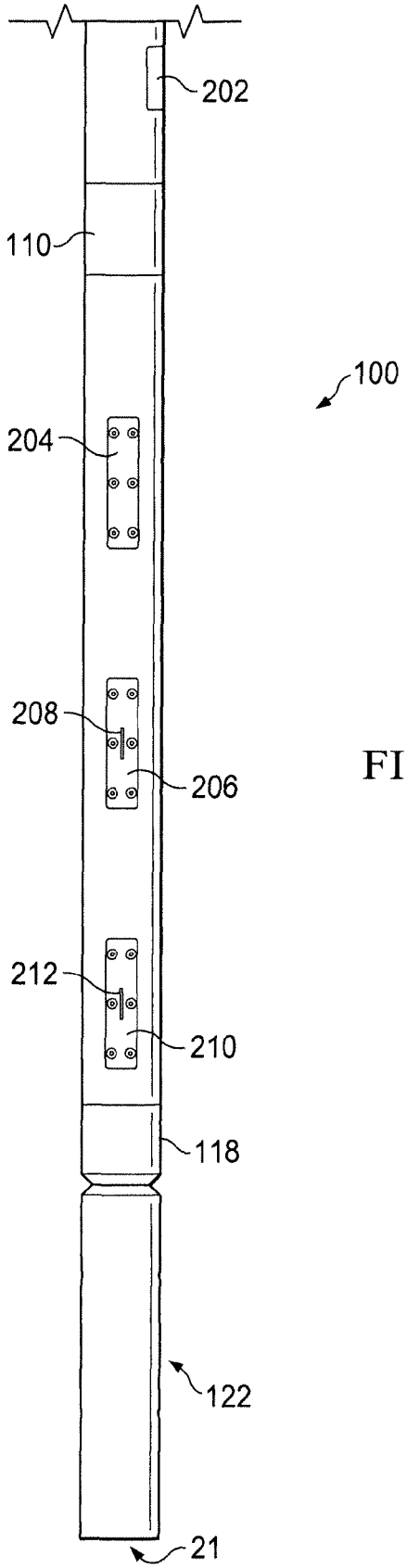
FIG. 2 is an exterior view of a lower end of the jarring tool of FIG. 1

Referring now to FIG. 2, an exterior view of a lower end of the jarring tool of FIG. 1 is shown. Here additional features can be seen that affect the performance of the tool 100. As described above, the tensile force required to activate the tool can be adjusted by varying the washer stack 142 and the retainer 140. These affect both the release point and the jarring force produced by the tool.

In addition to these adjustments, the behavior of the tool 100 following release can be fine tuned. It will be appreciate that well fluids may enter the tool 100. The speed at which these fluids can be displaced, as well as the force required to move them, will have an effect on the jarring force and speed of the tool 100. It can be seen in FIG. 2 that various access ports or covers may be placed at locations along internal moving components of the tool 100. For example, access port 202 is proximate the washer stack 142. Access ports 204, 206 are provided proximate either side of the retainer 141. Access port 210 is near stop 118. By controlling how quickly fluid can displace from the washer stack 142, the latch pieces 128, 130, and the lower shaft 120, impact force can be increased or decreased. In the embodiment shown, access ports 208, 210 are provided with slots 208, 212, respectively. This allows for more rapid fluid flow into and out of the tool 100, which is tend to increase impact force and the speed with which the tool 100 releases or deploys. The size and number of openings in the access ports can be varied according to the desired function of the tool 100.

Access ports may also be useful for servicing or adjusting internal components. For example port 202 may be removed to provide access to the washer stack 142 and the stop 149.

It will be appreciated that various embodiments of the tool of the present disclosure can be utilized with a wide variety of drilling and downhole technology. Non-limiting examples include drill pipe, e-line, and slick line strings. Sub ends and housings may be chosen according to the work string. Similarly, the overall size of the tools 100 may be chosen based on well bore size and other requirements. Once located in the down hole work string, the tool 100 functions as ordinary drill pipe or other string segment until called upon to create an upward jarring force on the work string. In this respect, the tool 100 may be considered as a segment of sub housing with an extensible, jar producing joint in the middle.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A jarring tool comprising:

a segment of sub housing containing an upper stop proximate a first end thereof;

an outer latch piece connected to an upper end of the lower shaft inside the sub housing;

an upper shaft passing through the stop and connecting on a first end thereof to an inner latch piece;

a cap on a second end of the upper shaft retaining a washer stack against the upper stop; and a two-piece retainer inside the sub housing, the retainer having a first piece providing a restraining region and an open region and a second piece attached to the sub housing and to the first piece;

wherein the retainer retains the inner and outer latch pieces in a latched position in the restraining region until the latch pieces are displaced toward the second end of the sub housing through the retainer to the open region as a result of a tensile force on the outer latch piece.

2. The tool of claim 1, further comprising a lower shaft attached to the outer latch piece on a first end thereof and providing a sub end on a second end thereof

3. The tool of claim 2, further comprising a lower stop proximate the second end of the sub housing, the lower stop having a passage sized to permit extension of the lower shaft therethrough and away from the sub housing and to stop the extension of the shaft by contact with a shoulder of the shaft at a predetermined extension.

4. The tool of claim 1, further comprising a second segment of sub housing attached to the upper stop and having an externally visible indicator that displaces and remains displaced in response to contact from the upper shaft cap resulting from unlatching of the inner and outer latch pieces.

5. The tool of claim 1, further comprising an intermediate shaft arranged in a sliding and concentric relationship to the inner and outer latch pieces to define a protected passageway.

6. The tool of claim 1, further comprising an access port defined in the sub housing, and an attached cover plate defining an opening of a predetermined size to control fluid flow into and out of the sub housing.

7. The tool of claim 1, wherein the tensile force required to unlatch the first and second latch pieces being may be controlled by moving the first retainer piece relative to the second retainer piece by a threading engagement.

8. The tool of claim 1 wherein the outer latch piece is a collet that grasps the inner latch piece when latched.

9. A latch for a downhole jarring tool, comprising:

a retainer defining a restrictive region and an open region therein, the retainer having cooperating first and second pieces whereby the restrictive region is axially adjustable by moving the first and second pieces relative to one another;

an outer latch piece; and an inner latch piece that is biased against movement through the retainer;

wherein the retainer retains the inner and outer latch pieces in a latched configuration in the restrictive region and allows the inner and outer latch pieces to unlatch when tensile forces applied to the outer latch piece move the latch pieces into the open region; and wherein the first and second retainer pieces are in an adjustable fixed relationship such that the first and second pieces remain fixed during unlatching of the inner and outer latch pieces and are manually adjustable relative to one another to move the restrictive region.

10. The latch of claim 9, wherein the retainer is anchored by a sub segment.

11. The latch of claim 9, wherein the inner latch piece is biased against movement through the retainer by a shaft attached to a spring washer stack.

12. The latch of claim 9, wherein the outer latch piece is connected to a sub end.

13. The latch of claim 9, further comprising an intermediate shaft passing through the inner and outer latch pieces both in the latched and unlatched configuration.

14. The latch of claim 9, further comprising:

a substantially cylindrical housing circumscribing the retainer and having a stop in one end thereof; and a shaft passing through the stop and connected to the outer latch piece inside the housing;

wherein the shaft provides a shoulder for impacting the stop to create a jarring impact in response to a tensile force applied to the shaft that unlatches the first and second latch piece.

15. The latch of claim 9, wherein the cooperating first and second pieces each define cooperatively threaded cylinders.

16. A jarring tool comprising:

a lower sub housing;

a center sub housing;

an upper sub housing;

an upper connector attaching the upper and center sub housings;

a lower connector attaching the lower and center sub housings;

a lower stop fitted into a bottom of the lower sub housing;

a lower shaft fitted through the lower stop and attached to a lower sub end, the lower shaft providing a shoulder inside the lower sub housing for contacting the lower stop when extended from the lower sub housing;

an outer latch piece attached to the lower shaft inside the lower sub housing;

an upper shaft passing through an upper stop in the upper connector and having a lower end attached to an inner latch piece and an upper end attached to a cap;

a spring washer stack arranged concentrically around the upper shaft between the cap and the upper stop; and a retainer in the lower sub housing having a restraining region;

wherein the inner and outer latch pieces are restrained by the restraining region in a latched position until displaced through the restraining region due to a tensile force on the upper sub housing and lower sub end; and wherein the restraining region is in a fixed relationship with the lower sub housing, the fixed relationship being adjustable by rotation of the restraining region about a central axis of the jarring tool.

17. The tool of claim 16, further comprising an intermediate shaft attaching the upper shaft to the inner latch piece and being arranged concentrically within the inner latch piece, the intermediate shaft passing through the outer latch piece and into a sliding arrangement within the lower shaft such that a protected passageway is defined through the inner and outer latch pieces.

18. The tool of claim 16 further comprising:

an activation rod retained in the upper connector and proceeding partially out of the connector toward the cap; and a spring loaded indicator cooperatively engaged with the activation rod and externally visible from the tool;

wherein the indicator is retained in a first position by the activation rod until the activation rod is displaced into the upper connector by the cap whereupon the indicator is released to move into a second position indicating activation of the tool.

19. The tool of claim 16, wherein the outer latch piece is a collet that grasps the inner latch piece when in a latched position.

20. The tool of claim 16, further comprising a bias spring interposing the upper stop and the inner latch piece urging the inner latch piece into the restrictive region.

* * * * *